US005666797A

United States Patent [19]

Bruske et al.

[11] Patent Number: 5,666,797

[45] Date of Patent: Sep. 16, 1997

[54] HEATING DEVICE WITH EXCHANGEABLE YARN GUIDES

[75] Inventors: Johannes F. Bruske, Remscheid; Siegfried Morhenne, Breckerfeld, both of Germany

[73] Assignee: Barmag AG, Remscheid, Germany

[21] Appl. No.: 541,919

[22] Filed: Oct. 10, 1995

[30] Foreign Application Priority Data

| | | | |
|---|---|---|---|
| Oct. 7, 1994 | [DE] | Germany | 44 35 961.6 |
| Feb. 16, 1995 | [DE] | Germany | 19 50 5169.6 |
| Mar. 2, 1995 | [DE] | Germany | 19 50 7194.8 |
| Jun. 14, 1995 | [DE] | Germany | 19 52 1650.4 |
| Jul. 13, 1995 | [DE] | Germany | 19 52 5534.8 |

[51] Int. Cl.[6] ..... D01H 7/92; D01H 7/46

[52] U.S. Cl. ..... 57/290; 28/249; 57/284; 57/352

[58] Field of Search ..... 57/282, 284, 287, 57/288, 290, 352; 28/240, 249, 258; 219/388

[56] References Cited

U.S. PATENT DOCUMENTS

| | | | |
|---|---|---|---|
| 2,990,670 | 7/1961 | Kingsbury | 57/284 |
| 4,567,721 | 2/1986 | Kuroda et al. | 57/284 |
| 5,148,666 | 9/1992 | Bauer et al. | 57/284 |
| 5,353,583 | 10/1994 | Tanae et al. | 57/288 |
| 5,438,820 | 8/1995 | Nakahara et al. | 57/284 |
| 5,528,893 | 6/1996 | Yanagihara et al. | 57/290 |

FOREIGN PATENT DOCUMENTS

| | | | |
|---|---|---|---|
| 483989 | 5/1992 | European Pat. Off. | 57/284 |
| 4318674 | 12/1993 | Germany | 57/284 |
| 4318675 | 12/1993 | Germany | 57/284 |
| 5-125629 | 5/1993 | Japan | 57/287 |

*Primary Examiner*—William Stryjewski

*Attorney, Agent, or Firm*—Bell, Seltzer, Park & Gibson, P.A.

[57] ABSTRACT

A heating device for heating an advancing yarn, which has a groove in which the yarn advances along a zigzag line. To advance the yarn in the groove, yarn guides are provided, which are arranged spaced apart from each other on a common carrier so as to form a unitary structural unit. The structural unit is inserted on the bottom of the groove, and rests against the side walls of the groove. The yarn guides are configured as pins.

18 Claims, 6 Drawing Sheets

HEATING DEVICE WITH EXCHANGEABLE YARN GUIDES

FIELD OF THE INVENTION

The invention relates to a heating device for heating a yarn in a crimping machine.

BACKGROUND OF THE INVENTION

In particular, the present invention is directed to crimping synthetic filament yarns in a false twist crimping machine wherein heating devices are provided to advance a yarn therethrough in a heated groove. The heating device according to the present invention may comprise several grooves, each of which accommodates one yarn.

A prior art heating device is described in EP 0 412 429 B1 and U.S. Pat. No. 5,148,666 wherein the heating device includes a heated groove in which the yarn is guided along a zigzag line. The zigzag line is defined by several yarn guides, each constituting a turning point of the line accommodating one yarn guide.

Prior art heaters are operated at a temperature which is substantially higher than 300° C. At these temperatures, a portion of the organic compounds of the yarn evaporates, whereas anorganic compounds deposit on the yarn guides. These deposits occur because the yarn comes into contact with the surface of each yarn guide. These deposits increase after repeated use. An increase in the deposits causes the yarn to no longer be urged to follow a predetermined path. However, the yarn path in the heater influences the quality of the yarn. Accordingly, the quality of the yarn can be influenced by the deposits.

The structural design of prior art heaters renders cleaning of the individual yarn guides relatively expensive. In addition, the deposits are very hard due to the temperatures in the heater, and they are difficult to remove from the yarn guides.

SUMMARY OF THE INVENTION

It is therefore an object of the present invention to simplify the cleaning of the yarn guides.

A further object of the present invention is to reduce the production requirements and, thus, likewise the cost of manufacturing a heating device.

This object is achieved by providing a heating device for heating an advancing synthetic filament yarn, which comprises a body member having an elongate groove with substantially parallel side walls, and a structural unit positioned in the groove and comprising an elongate carrier together with a plurality of yarn guides. The yarn guides are configured as pins to advance the yarn in the groove along a zigzag path. The structural unit rests against the side walls of the groove. The carrier is a solid, heat conductive, metallic body, which is configured to be placed on the bottom of the groove, and which is configured to mount the yarn guides so as to extend in the groove upwardly therefrom.

The heating device of the present invention is characterized in that the yarn guides are designed and configured as pins, and they are attached to a solid, highly heat-conductive carrier. As a result of the high heat conductivity, an insulating effect is absent during the heating of the groove. The solid construction of the carrier imparts to the structural unit an inherent stability, which is advantageous especially during an exchange and a subsequent cleaning process.

The structural unit is easily removed from the groove of the heating device. After removing the carrier with the yarn guides, it can be easily cleaned, since the yarn guides are readily accessible from all sides. In addition to the eased cleaning benefits of the yarn guides, no expensive measures are needed to arrange the yarn guides in the channel.

In one embodiment, the yarn guides are arranged on the carrier so that the yarn is advanced along a zigzag line. Preferably, the spacings between the yarn guides are equal. The clamping force between the structural unit and the groove walls is absorbed by the yarn guides. As a result, the contact surface is considerably reduced between the structural unit and the side walls of the groove.

In another embodiment, the arrangement of two successive yarn guides on one side has the advantage that the looping angle on each yarn guide is reduced by 50%.

An embodiment of the heating device comprises yarn guides which are attached to the carrier such that they are supported indirectly on the opposite side walls of the groove. To this end, the yarn guide may be followed by a correspondingly curved section which may be bent, for example, into an L-shape, U-shape, or T-shape. The yarn guides are arranged at least on one carrier, in a zigzag-shape and support itself on the opposite side wall. This configuration permits each yarn guide to be pushed by the carrier against the side wall of the groove, the yarn guide thereby assuming a stable position. The force which the carrier exerts on the yarn guides may be adjusted by corresponding fits or resilient characteristics of the carrier. The clamping of the yarn guides is of sufficient strength to prevent the yarn guides from being moved out of their position by the yarn advancing therealong.

In a preferred embodiment identical yarn guides are arranged on both sides of the carrier. The width of the carrier and the width of a yarn guide correspond approximately to the width of the groove. For example, it is possible to mount each yarn guide only on a carrier associated to it. The carrier with the yarn guides are then fitted into the groove. This requires that the position of the yarn guides relative to each other in the longitudinal direction be exactly readjusted each time. In both cases, a structural unit is initially produced, which consists of an elongate strip and the yarn guides attached thereto. Preferably, the strip has plane parallel lateral surfaces, to which the yarn guides can be attached, for example, by welding. The yarn guides are arranged on both sides of the strip offset from each other in the longitudinal direction. Upon inserting the strip with the yarn guides into the groove, the spring elastic strip is clamped in zigzag shape in one embodiment, since the overall width of two adjacent yarn guides and the strip is at least wider than the groove, namely at least by the width of the strip. As a result, the strip is deflected to a zigzag line, and due to its elasticity, it pushes the yarn guides of opposing sides against the associated groove walls. If the carrier with the yarn guides is arranged in the groove, the carrier will be forced to follow a zigzag line. In so doing, the yarn guides are pushed with one of their sides against a side wall of the groove. The zigzag path of the yarn is determined by the tolerances of the groove, the yarn guides and the carrier. As a result of the arrangement of the yarn guide, the yarn is safely supported relative to the groove bottom, without it being possible that the yarn is clamped at the junctions between each yarn guide and the carrier.

In another embodiment, no use is made of a spring-elastic strip, or the spring elasticity has no effect. This embodiment is advantageous, especially when a loss in the spring effect is to be expected because of the high temperatures. In this instance, one yarn guide and the width of the strip fill the entire width of the groove.

The two aforesaid embodiments have the advantage that the structural units consisting of a strip and yarn guides may be pulled out from the groove, either from the upper side thereof or, also, in the longitudinal direction. It is not necessary to readjust the carrier and the yarn guides after cleaning. Upon the removal of the structural unit by pulling it out lengthwise, the groove is likewise cleaned, so that a substitute structural unit may again be inserted immediately.

In accordance with a further embodiment, two carriers are provided. These carriers are arranged in the groove so as to overlie one another. Each carrier accommodates only yarn guides, which rest against the same side wall of the groove. The individual carriers may be releasably joined to each other, so as to form one structural unit. This proposed layout for the arrangement of the carriers and yarn guides has the advantage that it is possible to exchange individual carriers with the yarn guides, for example, when same are worn.

Preferably, the flexible carrier has a zigzag configuration. This zigzag configuration has the advantage that the carrier is supported on several points of the side wall of the groove.

An embodiment of the present invention has the advantage that the clamping force is absorbed exclusively by the carrier, or adjusted by the fit that is selected between the carrier and the groove. Furthermore, this arrangement precludes a contact between the yarn guides and the side wall, which results in an advantageous, low surface temperature of the yarn. The carrier is held in the groove bottom both in force-locking and in form-locking engagement.

Suitably, the carrier has a rectangular cross section. This design has the advantage that it permits a simplified connection for the carrier with the individual yarn guides. Further, the carrier is supported on the side wall along a line.

The carrier having a rectangular cross section may be a sheet metal strip, which has spring-elastic characteristics. However, the spring-elastic characteristics of the carrier are independent of the cross section and the configuration of the carrier.

Preferably, the carrier and the yarn guides consist of a metallic material. This has the advantage that the yarn guides can be joined to the carrier inseparably, for example, by welding or soldering. In the case of carriers having a great inherent stability, it is also possible to join yarn guides of a nonmetallic material in a simple manner by force-locking or formlocking engagements with the carrier.

To ensure that the wear resistance of the yarn guides is adequate, the yarn guides may be provided with a coating of hard material.

It is not necessary that the carrier extend over the entire length of the heating device. The zigzag course of the yarn may be realized likewise, in that several carriers with yarn guides are arranged, one following the other directly or indirectly. The arrangement of several longitudinal segments, one following the other, permits the formation of several heating zones with differently spaced yarn guides.

BRIEF DESCRIPTION OF THE DRAWINGS

Further advantages and features of the heating device in accordance with the invention are described in more detail with reference to the drawings, in which.

DETAILED DESCRIPTION OF THE PREFERRED EMBODIMENTS

Figure 1A:
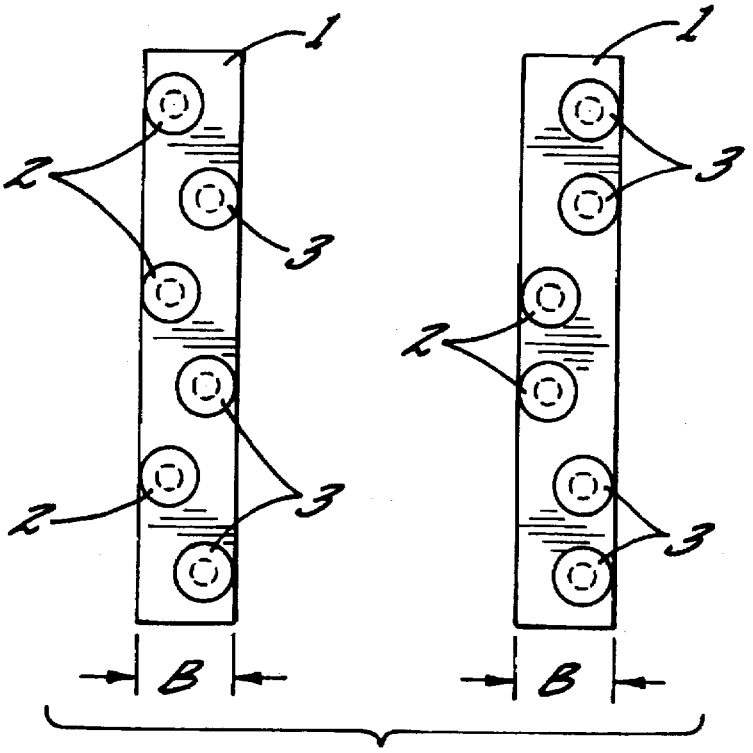
FIG. 1*a* is a top view of a structural unit with a carrier and yarn guides.
Figure 1B:
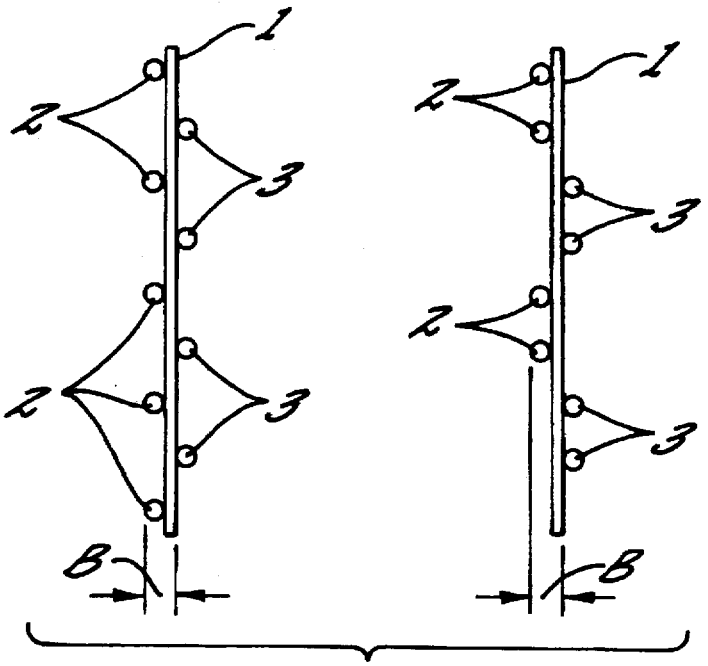
FIG. 1*b* is a top view of a structural unit with a flexible carrier and yarn guides.
Figure 1C:
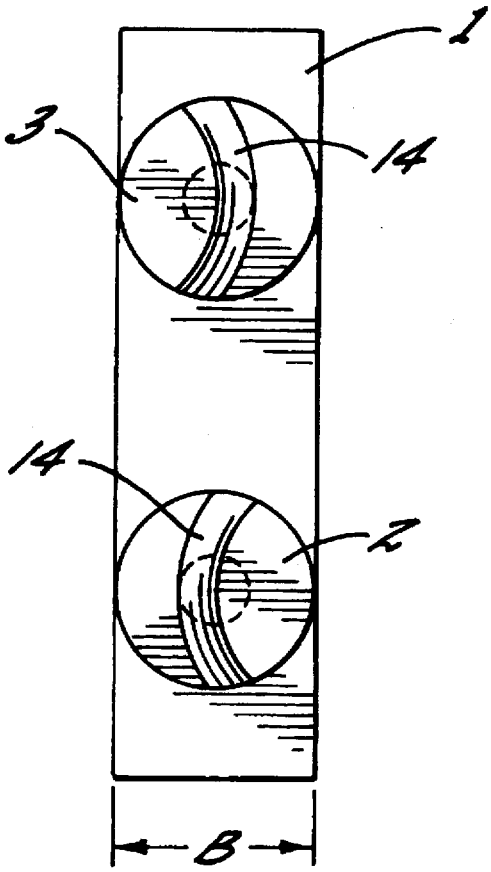
FIG. 1*c* is a top view of a structural unit with a carrier and yarn guides.

Shown in FIGS. 1*a*, 1*b*, and 1*c* are top views of different embodiments of a structural unit, which consist each of a carrier 1 and yarn guides 2 and 3 respectively. The yarn guides 2 and 3 have a circular cross section. Other cross sections are also possible. In particular, cross sections may be selected which direct the yarn to a contact surface with a large radius, as shown by way of example both in FIG. 1*c* and in FIG. 2.

For carrier 1, as shown in FIGS. 1*a* and 1*c*, a flat steel or a strip steel may be used, which has a width B. The width B and the width of the groove are approximately the same or adapted such that the structural unit is held in the groove in force-locking engagement. In this instance, the clamping forces are selected such that the yarn guides remain unchanged in their position during the operation. The carriers are made solid, i.e., they are bar-shaped with a square, rectangular, circular, semicircular, or polygonal cross section.

Figure 2:
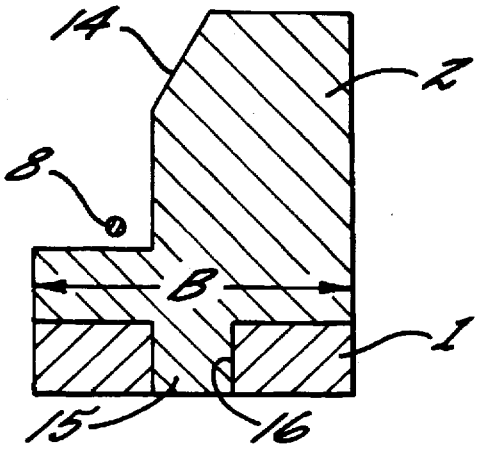
FIG. 2 is a cross sectional view of a structural unit with carrier and yarn guides.

The yarn guides 2 and 3 are each mounted on the surface of carrier 1 by way of a press fit, as shown in FIG. 2, or by welding or soldering.

In FIG. 1*a*, the yarn guides 2 and 3 respectively are configured as pins, which are arranged on the surface of carrier 1, so that they come to lie, alternately or in pairs, on both longitudinal sides of carrier 1. Thus, the spacing between the sides of yarn guides 2 and 3 facing away from each other is approximately equal to the width B, so as to permit the yarn guides 2 and 3 to be supported each on side walls 6 and 7 of groove 4 (note, FIG. 4*a*). Each of the yarn guides 2 and 3 has a diameter which is larger than half the width B, thereby realizing a zigzag path of the yarn.

As shown in FIG. 1*b*, a carrier 1 having the form of a lengthwise extending strip with two parallel sides, accommodates on both sides yarn guides 2 and 3 respectively. The carrier 1 may be a round wire or a rectangular strip or a strip with parallel sides. The yarn guides 2, 3 are attached to the carrier in equally spaced-apart relationship. The yarn guides 2, 3 may be joined to carrier 1 by welding, soldering, or the like. The yarn guides shown in FIG. 1*b* have the same diameter. The width B, which is composed of the diameter of yarn guide 2 or 3 and the width of carrier 1, is somewhat larger than the width of groove 4, which is formed in a heating device 5.

Likewise shown in FIG. 1*c* is an arrangement, in which the yarn guides 2 and 3 respectively are located on the surface of carrier 1. In this embodiment, the yarn guide 2 and 3 have each on their end facing the carrier a diameter on the order of width B, as shown in FIG. 2. At about two thirds of its length, the yarn guide has an almost elliptically shaped cross section with a width that is greater than half the width B. The yarn 8 contacts the yarn guide at a large radius, so that it has a great length of contact with a small angle of looping. The L-shape of the yarn guide prevents the yarn 8 from coming into contact with carrier 1 and, thus, avoids an excessive heating. For its mounting, the yarn guide 2 or 3 is pressed with a pin 15 into a bore 16 of carrier 1. To facilitate the threading of the yarn, the free end of yarn guide 2 or 3 is provided with a bevel 14.

Figure 3A:
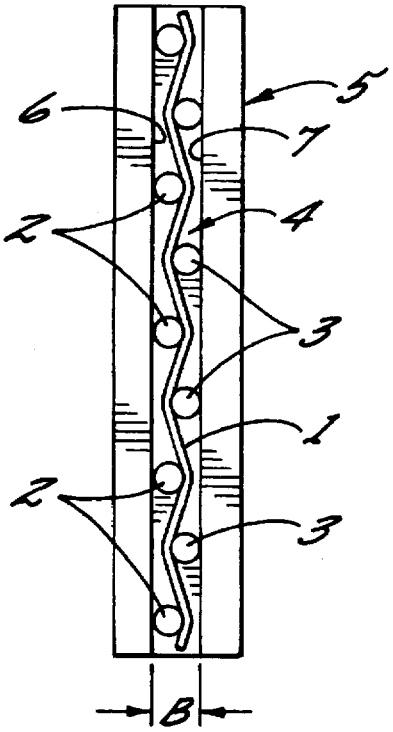
FIG. 3*a* is a schematic top view of a heating device with carrier and yarn guides of FIG. 1.2

FIG. 3*a* illustrates a heating device 5 which comprises a body member having an elongate, U-shaped groove. Inserted into this groove is carrier 1 accommodating yarn guides 2, 3 of FIG. 1*b*. When inserting carrier 1 with yarn guides 2, 3, the carrier 1 is forced to assume the direction of a zigzag line. The individual yarn guides 2, 3 rest against a side wall 6 and 7 respectively of the groove 4. The carrier 1 is supported alternatingly on side wall 7 and 6 respectively. In one embodiment the strip which forms the carrier, is preferably elastic and remains elastic, even when heated to more than 400° C.

Figure 3B:
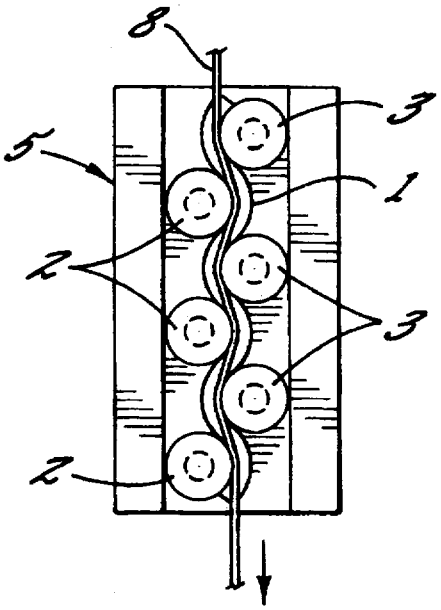
FIG. 3*b* is a schematic top view of a heating device with yarn guides and carrier.

Shown in FIG. 3*b* is the top view of a heating device, which also illustrates the path of a yarn 8.

Figure 3C:
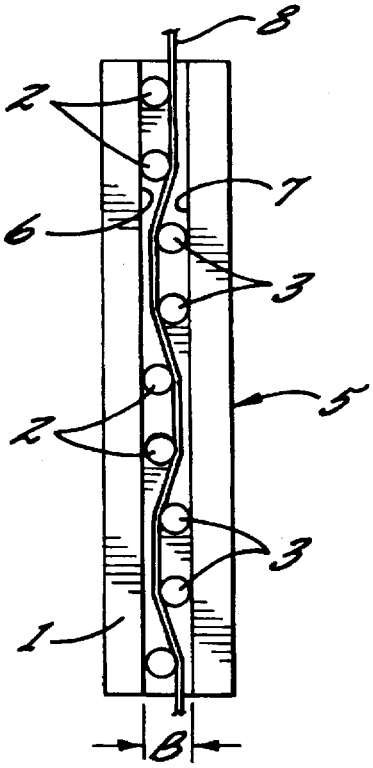
FIG. 3*c* is a schematic top view of a heating device with yarn guides and carrier of FIG. 1.1.

FIG. 3*c* illustrates a heating device 5 with an elongate, U-shaped groove, into which a carrier 1 of FIG. 1*a* is inserted so as to extend on the bottom thereof. A pair of yarn guides 2 and 3 is arranged alternately on the one side and on the opposite side of the carrier. This arrangement allows to reduce the looping angle on each yarn guide by 50%. Thus, the yarn is subjected to less friction, which again manifests itself in a lesser change in yarn tension and, thus, in a higher yarn quality.

Figure 4A:
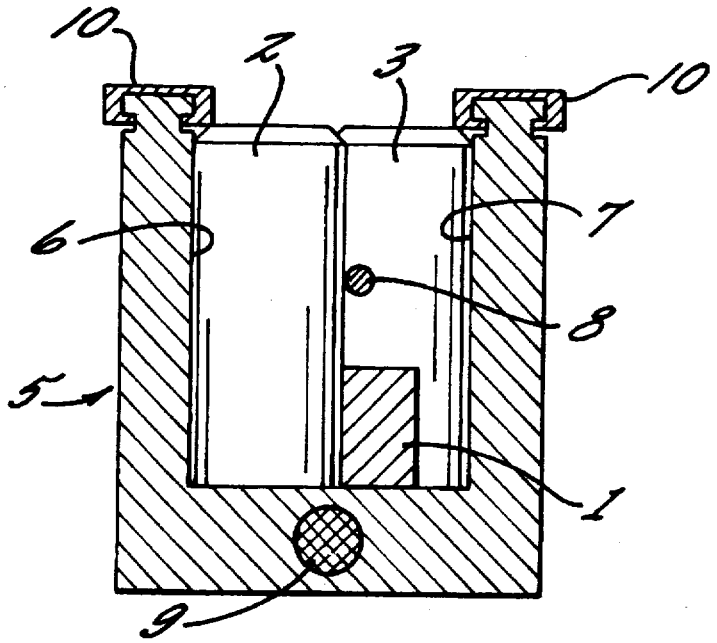
FIG. 4*a* is a vertical sectional view of a heating device.

FIG. 4*a* is a vertical sectional view of this embodiment. The heating device is also an elongate rail as shown in a shorter length, though, in FIG. 3*b*. Arranged in the rail is a longitudinal groove with two parallel side walls 6, 7. Clamped into the longitudinal groove is a structural unit, which comprises a strip-shaped carrier 1 with yarn guides 2 and 3 attached to the sides thereof. The yarn guides are arranged on both sides, offset and equally spaced apart from one another. Upon clamping the structural unit into the groove, the carrier 1 is deformed to a winding position, so that the structural unit is fitted therein under the action of elastic clamping forces. The heating device is heated by an electric resistance heating element 9 that is constructed in the form of a rod. This rod is inserted into a bore, which is provided lengthwise in the base plate of the heating device. It should be remarked that the cross sectional view of FIG. 4*a* applies likewise to the description of FIG. 3*a*.

The yarn guides 2, 3 are secured in the groove by caps 10. These caps 10 are C-shaped. They embrace the upper, longitudinal edge of each side of the groove, and engage into small, longitudinal channels, which are provided in the side walls 6, 7 of the groove sides on both sides of the upper, longitudinal edges. This description applies also to FIGS. 1*b* and 3*a*.

Figure 4B:
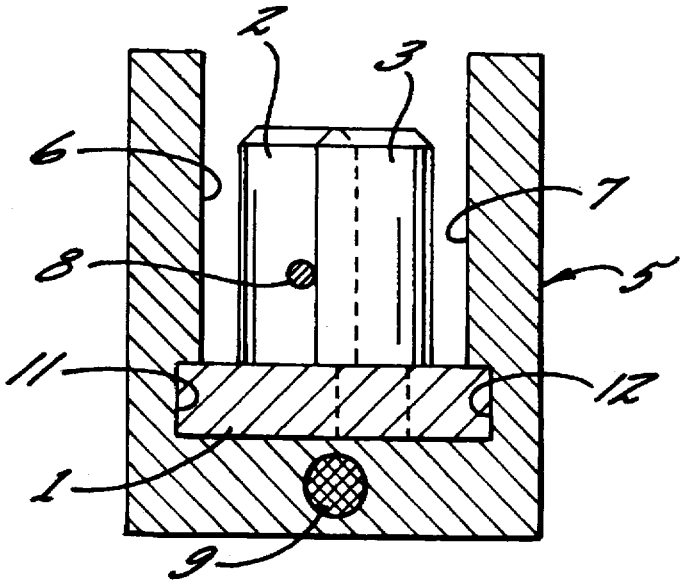
FIG. 4*b* is a vertical sectional view of an alternative embodiment of a heating device.

FIG. 4*b* is a vertical sectional view of a heating device with a plate-shaped carrier 1. The yarn guides 2 and 3 are arranged each on carrier 1, as shown in FIG. 1*a*, the spacing between the sides of the yarn guides 2 and 3 that face away from each other being smaller than the width B. As a result, there is no contact between the side walls 6 and 7 of groove 4 and the yarn guides 2 and 3. The yarn guides 2 and 3 can no longer be heated by thermal conduction, so that a lower surface temperature exists on each of yarn guides 2 and 3.

In this embodiment, the side walls 6 and 7 of groove 4 are provided with an undercut 11 and 12 respectively, into which the carrier 1 engages, so that the structural unit is held in groove 4 in form-locking engagement.

Figure 5:
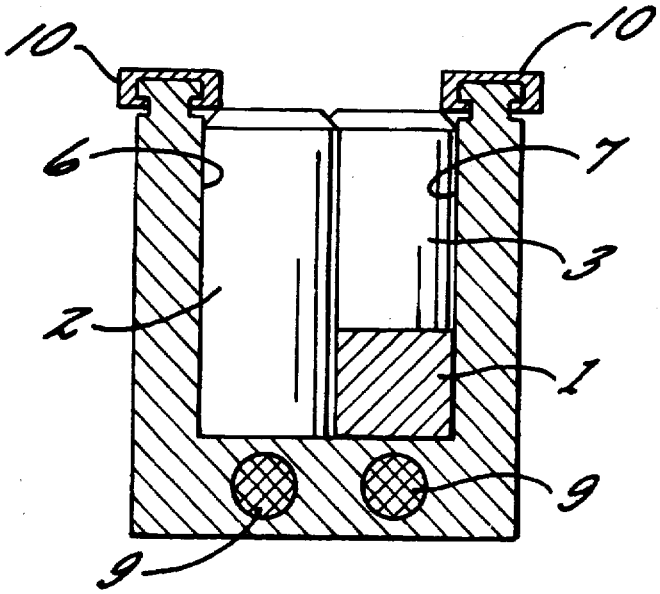
FIG. 5 is a vertical sectional view of a heating device with carrier and yarn guides.

The embodiment of FIGS. 5 and 6 comprises again the elongate heater, which contains a longitudinal groove with parallel side walls 6, 7. This longitudinal groove accommodates a structural unit. The structural unit consists again of a lengthwise extending carrier I with yarns guides 2, 3 mounted on its sides. In the longitudinal direction, the yarn guides 2, 3 are arranged equally spaced apart, but offset from one another on both sides of the strip-shaped carrier. The strip-shaped carrier is made in zigzag form, with a yarn guide being mounted in each cusp. The diameter of a yarn guide and the width of carrier 1 correspond exactly to the width of the groove. This allows to fit the structural unit into the longitudinal groove without a lateral clearance. The structural unit is again held in the groove by caps 10. Their description with reference to FIG. 4*a* is herewith incorporated.

At its end (note FIG. 6), the carrier is provided with holes 21. These holes can receive a suitable tool, which permits the carrier to be removed by pulling it out lengthwise from the groove. As a result, the groove is also cleaned. Immediately thereafter, a new carrier with the yarn guides attached thereto is introduced into the groove, so that for a cleaning the operation of the heating device is not interrupted as result of cooling. The carrier with the yarn guide element that is removed from the heating device can now be cleaned in a cleaning bath. It should be remarked that in this embodiment, two heating elements 9 are arranged in the bottom of the heating rail, thus achieving a more uniform heating over the width of the heater.

Figure 6:
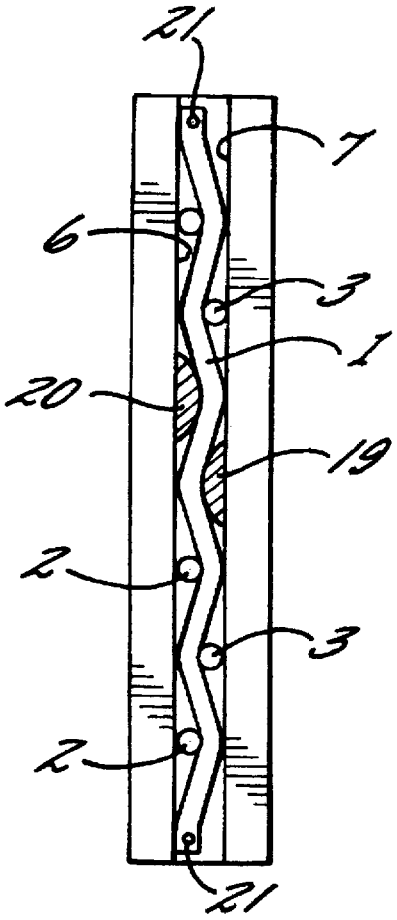
FIG. 6 is a top view of the embodiment of FIG. 5.

Shown in FIG. 6 are two yarn guides 19 and 20 with a substantially semicircular cross section. They contact the yarn with a large radius, so as to realize a great length of contact results at a small angle of looping. Other cross sectional shapes, such as, for example, ellipses are also possible. Such yarn guides substitute the circular pins, or alternate with same.

Figure 7:
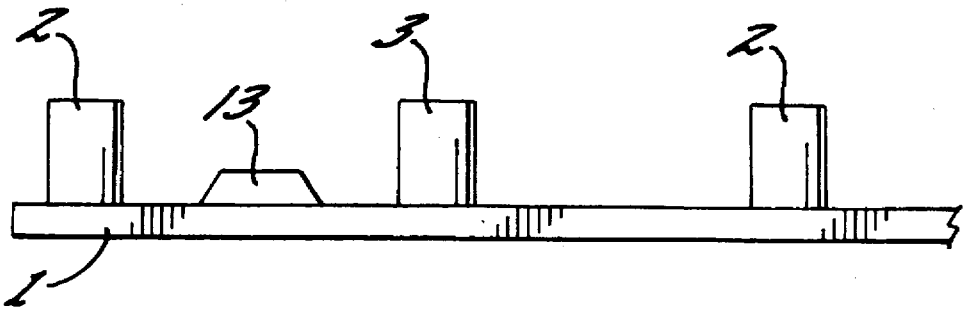
FIG. 7 is a side view of a structural unit with carrier and yarn guides.

FIG. 7 is a side view of a structural unit with a solid carrier and yarn guides, as has been described above with reference to FIG. 1*a* or FIG. 1*c*. In this embodiment, a bottom spacer 13 is arranged between two adjacent yarn guides 2, 3, so as to prevent the yarn from contacting the carrier. The high surface temperature of the carrier, which lies on the groove bottom would be liable to overheat the yarn.

Figure 8:
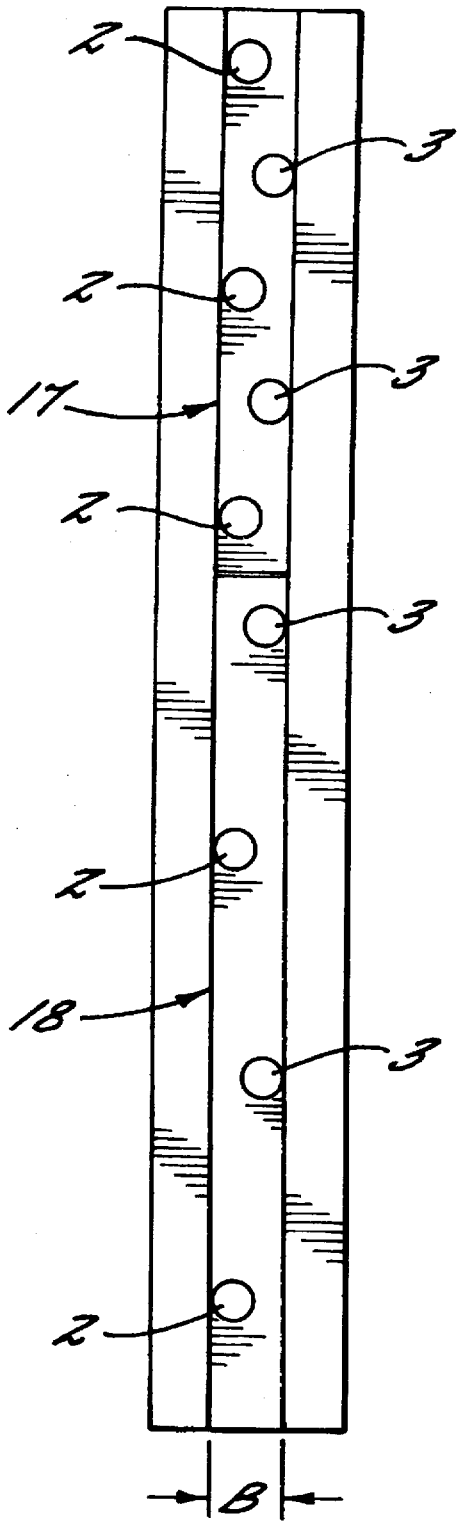
FIG. 8 is a top view of a heating device with a heated carrier divided into two longitudinal segments.

Shown in FIG. 8 is a heating device with an elongate, U-shaped groove, which accommodates a carrier that is divided into two longitudinal segments 17 and 18. The yarn guides 2 and 3 are differently spaced from each other over the length, so that the heating device has two zones which are used advantageously for purposes of optimizing the temperature and the yarn quality.

That which is claimed is:

1. A heating device for heating an advancing synthetic filament yarn, the device comprising a body member which includes an elongate groove having substantially parallel side walls, means for heating the body member, and a structural unit positioned in the groove, said structural unit comprising an elongate carrier and a plurality of yarn guides fixed to the carrier, the yarn guides being configured as pins and so as to advance the yarn in the groove along a zigzag path, and the structural unit resting against the side walls of the groove, and wherein the carrier is a solid, heat conductive, metallic body, which is configured to be placed on the bottom of the groove, and which is configured to mount the yarn guides so as to extend in the groove upwardly therefrom.

2. A heating device according to claim 1, wherein the elongate groove defines a longitudinal direction and a width, and wherein alternating in the longitudinal direction, one or more pins are attached on a first side of said carrier, and one or more pins are attached on a second side of said carrier, and the overall width of the structural unit consisting of said pins and said carrier is at least equal to the width of the groove.

3. A heating device according to claim 2, wherein the carrier is configured as a zigzag strip and the pins are mounted in cusps formed on both the first and second sides of said carrier, and the pins rest against the opposite side walls under the action of a spring elasticity of the carrier.

4. A heating device according to claim 3 wherein each cusp has a total width defined by the width of the carrier and the width of the pin which corresponds to the width of the groove.

5. A heating device according to claim 1 wherein the overall width of the structural unit comprising of said pins and said carrier is greater than the width of the groove and said carrier is elastically deformable and said pins rest against a wall of said groove.

6. A heating device according to claim 1, wherein said carrier is deformed to a zigzag line in a plane parallel to the groove bottom, so that it forms bulges offset from one another, wherein each bulge comprises at least one pin mounted therein, wherein the pin is laterally supported on the groove walls.

7. A heating device according to claim 1, wherein the elongate groove defines a longitudinal direction, a width, and a bottom, and wherein said carrier fills the width of the groove, and the yarn guides are attached to the side of the carrier which is opposite the bottom of the groove.

8. A heating device according to claim 7 wherein the spacing between the sides of the yarn guides that face away from each other is less than the width of the groove so that the yarn guides do not contact the side walls of the groove.

9. A heating device according to claim 1, wherein the elongate groove defines a bottom and contains an undercut in at least one of said side walls adjacent the bottom of the groove, and wherein the carrier extends into said undercut.

10. A heating device according to claim 1, wherein the carrier has a rectangular cross section.

11. A heating device according to claim 1, wherein the carrier comprises a spring elastic material.

12. A heating device according to claim 1, wherein the yarn guides comprise a metallic material.

13. A heating device according to claim 12, wherein the yarn guides are provided with a hard material coating.

14. A heating device according to claim 1, wherein the yarn guides are equidistant from each other.

15. A heating device according to claim 1, wherein the carrier is divided into longitudinal segments, and the yarn guides of each longitudinal segment are equidistant from each other.

16. A heating device according to claim 15, wherein the longitudinal segments are of the same length.

17. A heating device according to claim 15 wherein the yarn guides of one longitudinal segment are spaced apart a distance different from the spacing of the yarn guides of at least one other longitudinal segment.

18. A heating device according to claim 1 wherein said heating means comprises an electrical resistance heating rod positioned in a bore in said body member which runs parallel to said groove.

* * * * *